United States Patent [19]

Michel

[11] 4,230,466

[45] Oct. 28, 1980

[54] DISCHARGE ELECTRODE STRUCTURE FOR ELECTROSTATIC PRECIPITATOR

[75] Inventor: Thomas J. Michel, Hialeah, Fla.

[73] Assignee: Santek, Inc., Hollywood, Fla.

[21] Appl. No.: 37,533

[22] Filed: May 10, 1979

[51] Int. Cl.[2] ..... B03C 3/41

[52] U.S. Cl. ..... 55/147; 55/152; 361/230

[58] Field of Search ..... 55/118, 119, 146, 147, 55/150–152; 361/226, 229, 230, 231

[56] References Cited

U.S. PATENT DOCUMENTS

| | | | |
|---|---|---|---|
| 1,250,088 | 12/1917 | Burns | 55/118 |
| 2,409,579 | 10/1946 | Meston | 55/151 |
| 2,422,564 | 6/1947 | Pegg | 55/147 |
| 2,508,134 | 5/1950 | Anderson | 55/147 |
| 3,443,362 | 5/1969 | Ebert | 55/152 |
| 3,452,225 | 6/1969 | Gourdine | 55/146 |

FOREIGN PATENT DOCUMENTS

| | | | |
|---|---|---|---|
| 500574 | 1/1951 | Belgium | 55/152 |
| 700491 | 3/1931 | France | 55/147 |
| 119237 | 12/1918 | United Kingdom | 55/150 |

*Primary Examiner*—David L. Lacey
*Attorney, Agent, or Firm*—Michael Ebert

[57] ABSTRACT

An electrostatic precipitator for extracting particles and other contaminants from a gaseous stream to be purified, the contaminants being ionized by means of a discharge electrode structure which includes a column of dielectric material whose central axis is coincident with the axis of a collector tube within which the column is disposed. The column has a cross-sectional geometry that defines a circular series of longitudinally-extending niches. Supported between the ends of the column is a circular array of fine gauge wires each of which is suspended with a respective niche. A high voltage is impressed between the wires in the array and the inner surface of the collector tube to create an electrostatic field in the annular region between the discharge electrode structure and the tube to ionize contaminants in the gaseous stream passing therethrough. The surfaces of the niches acquire bound electrostatic charges whereby the voltage gradient established between the discharge electrode structure and the tube is substantially uniform, thereby attaining optimum collecting and ionization conditions.

8 Claims, 4 Drawing Figures

DISCHARGE ELECTRODE STRUCTURE FOR ELECTROSTATIC PRECIPITATOR

BACKGROUND OF INVENTION

This invention relates generally to discharge electrodes for electrostatic precipitators, and more particularly to a discharge electrode structure disposed within a tubular collector electrode and adapted to maintain a uniform high-intensity electrostatic field within the tubular electrode.

Electrostatic precipitators function to separate contaminating particles or droplets of a semi-solid or solid nature from a gaseous stream. Such precipitators are especially helpful in removing finer particles (less than 40 μm). In one known form of electrostatic precipitator, the gases to be purified, such as those issuing from an incinerator, are conveyed through a collector tube where they are subjected to an electrostatic field which causes the particles to migrate toward the inner wall of the collector tube, thereby separating the particles from the gas flowing through the tube. With continued operation of a dry precipitator, the particles accumulate on the wall of the collector tube and it becomes necessary, therefore, at fairly frequent intervals, to shut down the precipitator in order to permit removal of the agglomerated particles.

With a wet wall precipitator of the type disclosed, for example, in the deSeversky U.S. Pat. No. 3,716,966, a uniform film of downwardly flowing water is formed on the inner wall of the collector tube, the film serving to continuously wash away the contaminants, thereby obviating the need to interrupt the precipitator operation. The present invention is applicable to a dry or wet type of electrostatic precipitator in which the discharge electrode structure is coaxially supported within a tubular collector electrode.

In a coaxial electrostatic precipitator of the dry or wet type, unipolar ions are produced by a discharge electrode, the ions migrating across the gap between this electrode and the tubular collector under the influence of an electric field established therebetween. In so migrating, the ions attach themselves to the aerosol particles moving with the gas passing between the electrodes, the charged particles being attracted to the collector.

In one elementary form of coaxial electrostatic precipitator in widespread use, the discharge electrode is a wire coaxially supported within a tubular collector electrode. This wire has a much smaller radius of curvature than the tubular collector, the air gap or inter-electrode space between these electrodes being very large compared to the radius of the wire. When, therefore, a voltage is impressed across these electrodes and the potential difference therebetween is raised, a point is reached where the air near the more sharply-curved discharge electrode breaks down, but only to an extent producing a corona discharge.

The electric field varies inversely with the radius of the wire. For a given air gap dimension, the level of voltage needed to produce a corona discharge is below that necessary to completely break down the dielectric of air to produce a spark discharge across the gap. Since an understanding of this distinction is vital to the invention, the behavior of corona and spark discharges will be further analyzed.

A corona discharge is a highly active glow region surrounding a discharge electrode. In the above described elementary form of precipitator, this electrode is constituted by a wire, the glow region extending a short distance beyond the wire. Assuming that the wire is negatively charged, the free electrons in the gas in the region of the intense electric field surrounding the wire gain energy from this field to produce positive ions and other electrons by collision. In turn, these new electrons are accelerated and produce further ionization.

This cumulative process results in an electron avalanche in which the positive ions are accelerated toward and bombard the negatively-charged wire. As a consequence of such ionic bombardment, secondary electrons are ejected from the wire surface which act to maintain the discharge. Moreover, high-frequency radiation originating from excited gas molecules lying within the corona region contribute to the supply of secondary electrons.

The electrons emitted from the negatively-charged wire or discharge electrode are drawn toward the positively-charged collector electrode. As these electrons advance into the weaker field away from the wire, they tend to form negative ions by attaching themselves to neutral oxygen molecules. These negative ions create a dense unipolar cloud that occupies most of the gap between the electrodes and constitutes the only current in the entire space outside the corona glow region. This space charge functions to retard the further emission of negative charge from the corona region and in this way restricts the ionizing field adjacent the wire, thereby stabilizing the discharge.

When, however, the voltage applied to the ionizing electrode is further elevated to a level exceeding the point at which a corona discharge is maintained in a stable condition, the air dielectric then completely breaks down, as a result of which the air in the gap is rendered relatively conductive to sustain a spark discharge which is accommpanied by a heavy current flow.

An electrostatic precipitator attains its highest operating efficiency under optimum ionization conditions when the voltage applied to the discharge electrodes approaches the point of transition between an incomplete breakdown or corona discharge producing a copious supply of ions and complete air dielectric breakdown or spark discharge which effectively short circuits the precipitator and renders it inoperative.

But in practice one must be careful to apply a voltage to the ionizing or discharge electrode of a precipitator which is well below the level at which complete air breakdown is experienced, for the air breakdown characteristics of air in a precipitator varies with the nature and concentration of the pollutants therein as well as barometric pressure conditions. Moreover, the breakdown of the dielectric of air produces chemical reactions which constitute a serious health hazard; for this breakdown gives rise to toxic ozone and harmful oxides of nitrogen. But quite apart from this health hazard is the fact that ozone is highly reactive with electrical insulation and other structures and therefore has a destructive effect on the associated equipment.

When using a single ionizing wire as the discharge electrode, two problems are encountered whose possible solutions work at cross purposes. First, there is the problem of maintaining a uniform voltage gradient from the ionizing wire which extends along the axis of the collector tube to the inner wall of the tube. Second is the problem of maintaining the power supply voltage at a reasonable level in order to produce the desired high voltage gradient.

With a single-fine-gauge discharge wire extending coaxially within the collector tube, the voltage gradient about this wire to the suface of the tube (usually grounded) is uniform over a 360° polar angle from the center of the wire normal to its axis. We shall now, by way of example, assume a collector tube having an 8-inch diameter, a discharge wire having an 8-mil diameter and an excitation voltage of 30 kilovolts applied between the wire and the collector tube. The resultant voltage gradient between the wire and the collector tube is then approximately 7500 volts per inch. Because the discharge wire is of small diameter and is at a high voltage, it will readily ionize small particles suspended in a contaminated gas passing through the tube. As a result, the ionized particles will migrate toward the wall of the collector tube, this migration being induced by the intense voltage gradient.

If now one wishes to scale up a precipitator structure of this type so that it is then capable of handling a greater volume of contaminated gas, this can only be done by enlarging the diameter of the collector tube to, say, 16 inches. This doubles the distance between the center discharge electrode and the grounded collector tube and therefore reduces the voltage gradient between the discharge electrode wire and the grounded collector tube to about 3.75 KV per inch, or to one half of the previously effective value. As a consequence, fewer of the particles that are ionized are driven to the wall of the collector tube. This is particularly true of larger particles that have a high mechanical inertia and also of extremely small particles that do not readily accept a charge.

In order to raise the efficiency of the enlarged (16") precipitator to the level attained by the smaller (8") precipitator, the obvious step is to increase the voltage from 30 KV to 60 KV and thereby establish the same voltage gradient. The drawback to this obvious approach is not only that it entails a far more costly power supply, but now that one has doubled the voltage to maintain the same voltage gradient, the likelihood of an air breakdown that would short circuit the precipitator is greatly augmented.

Alternatively, rather than step up the power supply voltage, one could, upon enlarging the diameter of the collector tube, also expand the diameter of the coaxial discharge electrode wire. Thus when using a 16-inch diameter collector tube one could at the same time change the discharge electrode wire from an 8-mil diameter to one having an 8-inch diameter. But this solution is not effective; for a large diameter wire has poor air-ionizing characteristics.

Another approach to the problem is that disclosed in the above-identified deSeversky patent in which the discharge electrode is defined by a circular array or cage of wires. Thus in the case of a 16-inch collector tube, one may place an array of small gauge ionizing wires in a circle whose periphery is spaced four inches from the inner wall of the collector tube. The difficulty with this approach is that even though it enhances the voltage gradient, the wires themselves, because of their proximity to each other, create a non-uniform gradient in the air, as a consequence of which many particles in the gas passing through the tube are not adequately ionized and are therefore not collected.

SUMMARY OF INVENTION

In view of the foregoing, the main object of this invention is to provide a discharge electrode structure for use in conjunction with a tubular electrode of large diameter to produce an intense voltage gradient that is substantially uniform over a 360° polar angle, thereby ionizing virtually all contaminants in the gaseous stream passing through the tube.

More particularly, an object of this invention is to provide an improved discharge electrode structure of the above type which includes a circular array of wires which are electrostatically isolated from each other.

A significant advantage of a discharge electrode structure in accordance with the invention is that it makes possible a large capacity electrostatic precipitator of the wet or dry type wherein the voltage gradient is substantially uniform to effect ionization of the particles passing through the annular region between the array of discharge wires and the inner wall of the collector tube.

Briefly stated, these objects are attained in a discharge electrode structure which includes a column of dielectric material whose central axis is coincident with the axis of the collector tube within which the structure is disposed. The column has a cross-sectional geometry, preferably star-shaped, that defines a circular series of longitudinally extending niches. Supported between the ends of the column is a circular array of fine gauge wires, each of which is suspended within a respective niche so that the wires are electrostatically isolated from each other.

A high voltage is impressed between the array of wires and the inner surface of the collector tube, which is preferably grounded, to create an electrostatic field in the annular region between the discharge electrode structure and the tube to ionize the contaminants in the gaseous stream passing therethrough and to cause the ionized contaminants to migrate toward the collector tube. The surfaces of the niches acquire bound electrostatic charges whereby the voltage gradient between the discharge electrode structure of the tube is rendered substantially uniform.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Prior Art Electrostatic Precipitators

Figure 1:
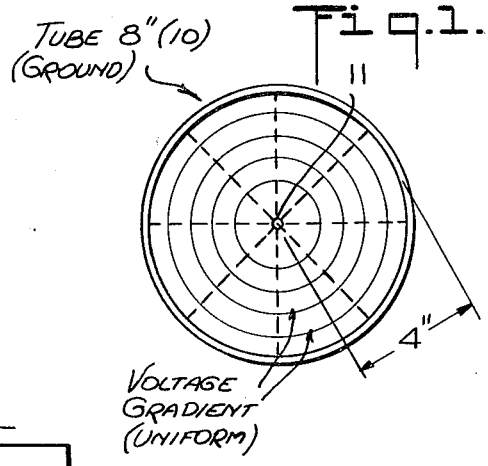
FIG. 1 illustrates the electrostatic field established in a conventional electrostatic precipitator in which a single discharge wire is coaxially disposed within a collector tube.

Referring now to FIG. 1, there is shown, by way of example, a conventional electrostatic precipitator having a collector tube 10, within which is coaxially disposed a fine discharge electrode wire 11. A high voltage is impressed between the wire and the tube.

In this example, collector tube 10 has an inner diameter of 8 inches; hence the radial distance between the wire and the surface of the tube is about 4 inches. The voltage gradient is represented in FIG. 1 by concentric circles and the electric lines of force by dashed radial lines. The voltage gradient in this arrangement is uniform, about a 360° polar angle from the center of the wire.

The difficulty with this arrangement, as previously explained, is that if it is scaled up by enlarging the diameter of the tube, then in order to maintain the same voltage gradient one must proportionately increase the power supply voltage. This increase may result in a breakdown of the air and spark discharges disrupting the operation of the precipitator.

Figure 2:
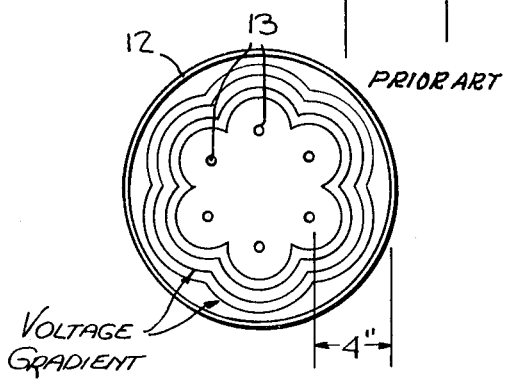
Fig. 2 PRIOR ART
FIG. 2 illustrates the electostatic field established in an electrostatic precipitator in which, in lieu of a single discharge wire, there is a circular array of such wires.

One prior art approach to enlarging the capacity of the electrostatic precipitator is to provide, as shown in FIG. 2, in conjunction with a collector tube 12 of, say, 16 inches in diameter, a circular array 13 of fine discharge electrode wires. The distance between the circle of discharge electrode wires and the inner wall of the collector tube is 4 inches; hence it is the same as the distance between the single discharge wire 11 and the wall of the 8-inch collector tube 10 in FIG. 1. Consequently, no greater operating voltage is required in the scaled-up FIG. 2 arrangement than in the smaller FIG. 1 arrangement.

However, the central region encircled by the array of wires has a zero voltage gradient, and particulate contaminants in the gaseous stream passing through this region will not be ionized. Moreover, because the wires in the array are in close proximity to each other, they interact electrostatically and the voltage gradient resembles a clover leaf pattern with a lobe about each wire. This gives rise to a voltage gradient between the wire array and the collector tube which is distinctly non-uniform. Hence the contaminated gas passing in the annular region between the tube and the array of wires will not be properly ionized and the precipitator will operate inefficiently.

The Invention

Figure 3:
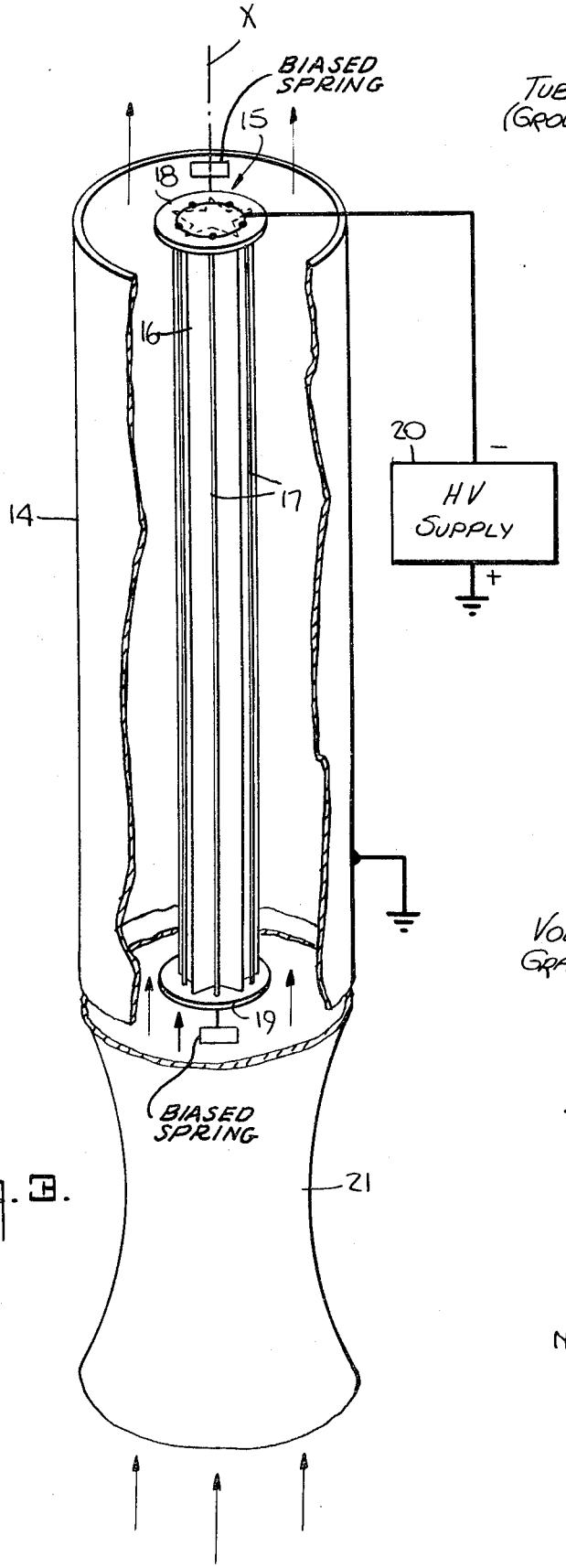
FIG. 3 is a perspective view, partially cut away, of an electrostatic precipitator which includes a discharge electrode structure in accordance with the invention.
Figure 4:
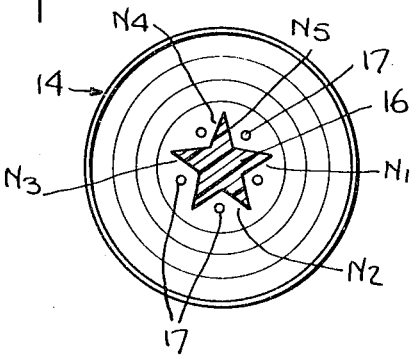
FIG. 4 is a transverse section taken through the discharge electrode structure shown in FIG. 3.

Referring now to FIGS. 3 and 4, there is shown a preferred embodiment of an electrostatic precipitator in accordance with the invention, the precipitator being constituted by a collector tube 14 within which is disposed a discharge electrode structure, generally designated by numeral 15.

Discharge electrode structure 15 includes a central column 16 whose center axis is coincident with the axis X of the collector tube, the length of the column being about equal to that of the tube. Column 16 is extruded or otherwise fabricated of a synthetic plastic material having good structural and dielectric properties which is capable of taking on an extremely high bound surface charge. Suitable for this purpose is acrylic, polycarbonate, polystyrene or plastics having similar properties.

The cross-sectional geometry of the column is such as to define a circular series of longitudinally-extending niches. In the example shown, the geometry is that of a five-pointed star which defines five triangular alcoves or niches $N_1$, $N_2$, $N_3$, $N_4$ and $N_5$. However, the invention is not limited to this configuration and the niches may be in either geometric forms such as arcuate alcoves.

The discharge electrode structure further includes a circular array of wires 17 whose diameter is preferably less than ten mils which extend between insulating discs 18 and 19 secured to opposite ends of the column, each wire being suspended within a respective niche. In practice, the end discs may be spring-biased as shown in block form in FIG. 3 to hold the wires under tension. The wires in the array are interconnected, a high voltage from a power supply 20 being applied to the wires. The other end of the power supply as well as collector tube 14 is grounded so that an intense electric field is established between the wires and the collector tube.

Where the precipitator is a dry precipitator, collector tube 14 must be conductive to form a collector electrode; but where the precipitator is wet, the tube need not be electrically conductive–for the water film which flows down the inner surface of the tube is gounded to operate as the collector electrode.

A contaminated gas is admitted to the lower end of collector tube 14, preferably through a Venturi inlet 21, this serving to cause the gas entering the collector to expand against the wet wall thereof to prevent the water film from being peeled off by the upward rush of incoming gas. A Venturi inlet is not necessary, however, with a dry precipitator.

In practice the gas may be admitted to the upper end of the wet precipitator and flow downwardly therein, no Venturi being used at the inlet.

Each niche-disposed wire 17 in the array disposed is the same radial distance from the center axis of the column and is parallel thereto. When a voltage is applied to the wires, the resultant electrostatic field establishes a bound surface charge on the niches. This results in a uniform voltage gradient between the ionizing wire and the circular ground plane, this being due to the uniform distribution of the electrostatic field on the wall of the niches. As soon as the bound surface charge on the plastic column is satisfied, the field tends to reflect precisely the same electrostatic voltage field applied to it by the ionizing wire.

With the shape of the niches properly engineered and having the correct aspect ratio, the voltage gradient from any center point of any ionizing wire or from any edge of any arm of the star-configured column to the concentric ground plane of the collector tube can be made very close to an equal value.

Another advantage of using the dielectric column which takes a high bound surface charge is that the potential difference across its entire surface is essentially zero. Therefore, the column is not susceptible to picking up contaminants that would cause grounding or arcing of the ionizing wires because of their close proximity to the column. Although in practice the plastic column may be supported by a grounded element or fixture, its high surface and volume resistivity will prevent it from leaking a significant amount of charge from the ionizing wires.

In the example given of an electrostatic precipitator in accordance with the invention, the diameter of the collector tube was given as 16 inches, as compared to the prior art single wire arrangement involving a collector tube of 8-inch diameter. The enclosed area in an 8-inch diameter tube is equal to 50.27 square inches, and the internal surface area is 25.13 square inches per linear inch to ground potential surface. For a 16-inch diameter tube, the area enclosed is 201.06 square inches, with an internal surface area of 50.27 square inches per linear inch. It is evident, therefore, that when using an unobstructed 16-inch diameter collector tube, the air flow is quadrupled at the same static pressure drop.

The column in the present arrangement is an obstruction in the 16-inch diameter collector tube. If we assume that the column occupies the central 8-inch diameter region within the tube in order to maintain a uniform voltage gradient and to provide good ionization, the resultant loss in total air flow is 25%. However, this represents three times more air flow with the same electrostatic characteristics obtained with a single wire in an 8-inch diameter collector tube.

While there has been shown and described a preferred embodiment of a discharge electrode structure for electrostatic precipitator in accordance with the invention, it will be appreciated that many changes and modifications may be made therein without, however, departing from the essential spirit thereof.

I claim:

1. An electrostatic precipitator for extracting particles and other contaminants from a gaseous stream, said precipitator comprising:

A a collector electrode tube;

B a discharge electrode structure disposed in said tube, said structure including a column whose center axis is coincident with the axis of the tube, said column being formed of dielectric material and having a cross-sectional geometry that defines a circular series of longitudinally-extending niches, and a circular array of fine gauge wires supported between the ends of the column, each wire being suspended within a respective niche, whereby the wires are electrostatically isolated from each other; and C means to impress a high voltage between the array of wires and the facing surface of the collector tube to create an electrostatic field in the annular region between the discharge electrode and the tube to ionize the contaminants in the gaseous stream passing therethrough, the surfaces of the niches acquiring bound electrostatic charges whereby the voltage gradient established between the discharge electrode structure and the tube is substantially uniform.

2. A precipitator as set forth in claim 1, wherein said cross sectional geometry has a star shape whereby said circular series of longitudinally-extending niches are defined by a plurality of like triangular niches.

3. A precipitator as set forth in claim 1, wherein said wires are supported by spring-biased disc means at the opposite ends of the column maintaining the wires under tension.

4. A precipitator as set forth in claim 1, wherein said wires have a diameter of less than 10 mils.

5. A precipitator as set forth in claim 1, wherein said precipitator is a dry precipitator and said collector tube is electrically conductive.

6. A precipitator as set forth in claim 1, wherein said column is formed of acrylic material.

7. A precipitator as set forth in claim 1, wherein said column is formed of polycarbonate.

8. A precipitator as set forth in claim 1, wherein said column is formed of polystyrene.

* * * * *